United States Patent [19]

Kessler

[11] 3,958,362

[45] May 25, 1976

[54] FLUID DISPENSING VALVE DEVICE FOR BUBBLE TOY

[76] Inventor: Milton Kessler, 6690 Harrington Ave., Youngstown, Ohio 44512

[22] Filed: Sept. 18, 1975

[21] Appl. No.: 614,762

[52] U.S. Cl. ..... 46/7; 138/37; 138/39; 239/590

[51] Int. Cl.[2] ..... A63H 33/28

[58] Field of Search ..... 46/6, 7, 8; 138/37, 138/39; 239/590

[56] References Cited

UNITED STATES PATENTS

| | | | |
|---|---|---|---|
| 646,378 | 3/1900 | Szamatolski | 138/39 X |
| 2,343,560 | 3/1944 | Klein et al. | 138/37 |
| 3,226,034 | 12/1965 | Helman | 239/590 X |
| 3,745,693 | 7/1973 | La Fata | 46/7 |

*Primary Examiner*—F. Barry Shay
*Attorney, Agent, or Firm*—Max L. Libman

[57] ABSTRACT

An improved fluid-dispensing valve device for a bubble-making toy such as described in U.S. Pat. No. 3,745,693. A dispensing valve is provided between a fluid reservoir of the toy and a bubble-making hollow stem unit such that the fluid stream path is broken up into a plurality of tiny separate paths which are then turned outward toward the hollow stem so as to provide a continuous and uniform flow of fluid to the bubble-making stem unit.

8 Claims, 4 Drawing Figures

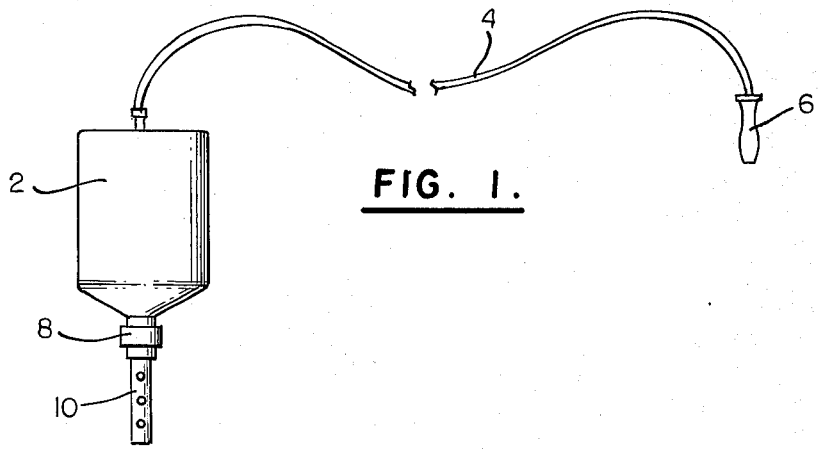
FIG. 1.
FIG. 2.
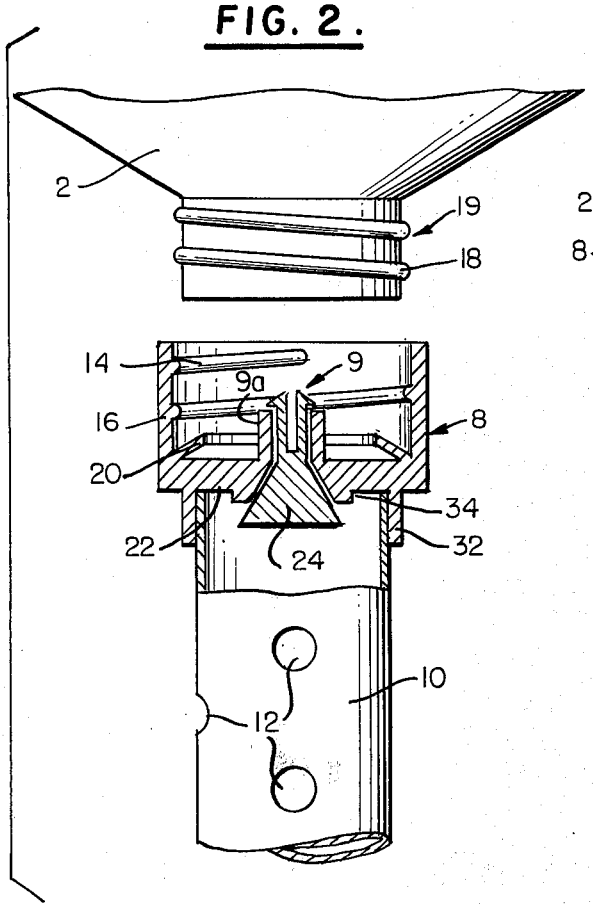
FIG. 3.
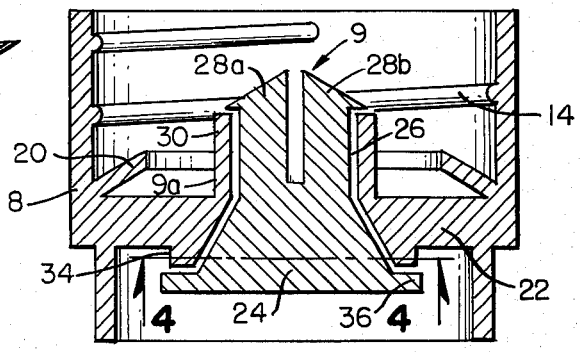
FIG. 4.
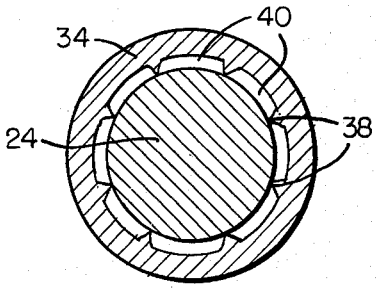

FLUID DISPENSING VALVE DEVICE FOR BUBBLE TOY

The bubble-making device shown in U.S. Pat. No. 3,745,693 is a highly successful toy, but has been found to occasionally fail to produce bubbles, apparently due either to clogging of the fluid-dispensing aperture or to inadequate or incorrect flow of fluid through the aperture. The present invention describes a new type of fluid-dispensing device for this toy which has been found to solve the difficulty. According to the present invention, the fluid stream from the reservoir to the bubble-making unit is broken up by a valve device into a plurality of very fine streams tapering outwardly from a central aperture and then further diverted outwardly toward the walls of the multi-ported hollow bubble-forming stem so as to provide a flow of fluid to uniformly and continuously cover all of the interior wall surface with a film of the fluid, which appears to be essential to the proper formation of a continual stream of bubbles, which is the purpose of the device.

The specific nature of the invention, as well as other objects and advantages thereof, will clearly appear from a description of a preferred embodiment as shown in the accompanying drawing, in which:

FIG. 1 is a side elevational view of the bubble-making toy showing its component parts;

FIG. 2 is an enlarged longitudinal sectional view of an improved valve-containing cap unit for the device of FIG. 1;

FIG. 3 is a further enlarged sectional view of the improved valve unit; and

FIG. 4 is a sectional view taken on line 4—4 of FIG. 3.

As shown in FIG. 1 and also in U.S. Pat. No. 3,745,693, the bubble-making toy consists of a reservoir 2 for bubble-making fluid (which is a rather soapy liquid solution), a flexible cord 4 attached to the bottom of the reservoir and having a handle 6 by which it can be swung, e.g. around the user's head, so that under the action of centrifugal force and gravity the fluid in the reservoir flows through a restricted aperture 9 in screw cap 8 into the interior of multi-ported hollow stem 10 which has a number of preferably different-sized ports or apertures 12 which form the bubbles, as is well-known and fully described in said Patent.

The screw cap 8 has an internal thread 14 on its cylindrical side wall 16 cooperating with an external thread 18 on the neck 19 of reservoir 2 whereby the cap may be threadedly fastened to the reservoir, a unitary internal flange seal 20 of a well-known type is also preferably provided to effect a good seal at the rim of the reservoir neck. It will be understood that this fastening means is a preferred type, but other fastening and sealing means could be used. The top wall 22 of the cap is provided with the restricted orifice mentioned, which is in this case a valve unit comprising a tapered plug 24 fitting into a correspondingly shaped tapered orifice 26 (FIG. 3) in the top wall 22 and preferably retained in place by two flexible barbed hook members 28*a* and 28*b* which are dimensioned to engage circular rim 30 of the orifice member 9. A cylindrical neck 9*a* provides a cylindrical portion on the reservoir side of the orifice 9 of the same internal diameter as the smaller end of the tapered portion of the orifice, and the hooked ends of the barbs engage the circular rim 30 of this neck. Any other suitable means for retaining the plug 24 in place could also be used, but the present construction enables easy and inexpensive assembly of the plug as it need only be snapped into place and engages itself properly.

The cap 8 has a cylindrical portion 32 on the opposite side of wall 22 from the reservoir for engaging the cylindrical hollow stem 10 which is thereby fastened to the cap in any suitable way as by gluing or stapling, etc. On this opposite side of wall 22 a rim 34 is preferably provided corresponding to the larger tapered diameter of orifice 9, and plug 24 is preferably provided with a radially extending flange 36 which is slightly spaced from rim 34 so that fluid issuing from the orifice will be directed radially toward the inner wall of hollow stem 9 and be uniformly spread thereon, after which the fluid moves down toward the ports 12 under the action of gravity or centrifugal force when the device is swung on cord 4. FIG. 2 shows the plug 24 without the flange.

The tapered portion of plug 24 is provided with nodes preferably in the form of ridges 38 (FIG. 4) spaced apart to provide a series of grooved passages 40 whereby the fluid from reservoir 2 flowing through orifice 9 is broken up into a series of fine channels, and then directed outwardly through the annular space between rim 36 and flange 34 as described above. Alternatively, the tapered surface could be smooth and the grooves made on the outer tapered surface of the plug 24 to produce the same effect.

What is claimed is:

1. a. An improved bubble-making toy having a bubble-fluid reservoir, a multiple-ported hollow stem and a restricted passage device between the two, wherein the improvement comprises a construction for said passage device comprising b. a plastic valve unit between said reservoir and said hollow stem, said unit having an aperture providing a passageway between said reservoir and said hollow stem, c. at least a portion of said passageway tapering outwardly on the side toward said stem so that the aperture is larger on that side than on the other side of the plastic unit, d. a plug in said passageway having a tapered portion fitting loosely into the taper of said passageway, e. and a plurality of small spaced-apart separate nodes providing a small separation between said tapered portions of the plug and the wall of said aperture, with passages for the fluid between said nodes so that the fluid stream from the reservoir to the stem is broken up into a plurality of thin streams, the apertures thus provided being sufficiently small so that the fluid drips rather than flows at a series of points as it passes from the reservoir into the hollow stem.

2. The invention according to claim 1, and a flange portion on said plug at the large end of said tapered portion extending laterally beyond said tapered portion and spaced from said plastic unit to divert the flow of fluid from the tapered passageway in a lateral direction toward the interior wall of said hollow stem.

3. The invention according to claim 1, and means for retaining said plug in said passageway comprising at least one flexible barbed member extending from the small end of said tapered portion of the plug through said passageway to engage said plastic unit on the side toward said reservoir.

4. The invention according to claim 1, said passageway having a cylindrical portion extending from the small end of said tapered portion toward the reservoir.

5. The invention according to claim 4, said nodes comprising a series of spaced-apart ridges extending from the larger end of the tapered portion of the passageway toward the smaller end.

6. The invention according to claim 5, said ridges being formed on the wall of said tapered portion of the passageway.

7. a. A flow-controlling plastic nozzle for connecting a reservoir of bubble fluid and a multi-ported hollow bubble-making stem comprising b. a plastic cap unit having a top wall and a cylindrical side wall, c. means on the cylindrical side wall for connecting said cap to a fluid reservoir, d. means on the outer side of the top wall for connecting the cap to a hollow bubble-forming cylinder, e. said top wall having an aperture tapering outwardly on the side toward said bubble-forming cylinder so that the aperture is larger on that side than on the other side of the cap, f. a plug in said aperture having a tapered portion fitting loosely into the taper of said aperture, g. and a plurality of small spaced-apart separate nodes providing a small separation between said tapered portions of the plug and the wall of said aperture with passages for the fluid between said nodes so that the fluid stream from the reservoir to the cylinder is broken up into a plurality of thin streams, the apertures thus provided being sufficiently small so that the fluid drips rather than flows at a series of points, as it passes from the reservoir into the hollow cylinder.

8. The invention according to claim 7, and means for retaining said plug in said passage comprising two flexible barbed members extending from the small end of said tapered portion of the plug through said passage to engage the cap on the side toward said reservoir, said barbs being oriented to engage opposite sides of the aperture.

* * * * *